US005207594A

United States Patent [19]

Olson

[11] Patent Number: 5,207,594

[45] Date of Patent: May 4, 1993

[54] ELECTRICAL POWER EXTENSION CORD

[76] Inventor: Thomas R. Olson, 2109 I St., Laporte, Ind. 46350

[21] Appl. No.: 761,482

[22] Filed: Sep. 18, 1991

[51] Int. Cl.[5] ..... H01R 13/717

[52] U.S. Cl. ..... 439/490; 340/656; 439/910

[58] Field of Search ..... 439/489, 490, 910; 340/656, 687

[56] References Cited

U.S. PATENT DOCUMENTS

| | | | |
|---|---|---|---|
| 1,935,771 | 11/1933 | Fuerstein et al. | 340/656 |
| 2,503,677 | 4/1950 | McHenry et al. | 439/490 |
| 3,020,518 | 2/1962 | Camping et al. | 439/910 |
| 3,611,257 | 10/1971 | Carkhuff | 439/606 |
| 3,757,102 | 9/1973 | Roberts | 439/490 |
| 4,118,690 | 10/1978 | Paynton | 340/687 |
| 4,671,597 | 6/1987 | Grill | 439/490 |
| 4,861,288 | 8/1989 | Friedman | 439/736 |

*Primary Examiner*—Neil Abrams
*Attorney, Agent, or Firm*—Longacre & White

[57] ABSTRACT

An electrical power extension cord having an illuminated connecting body at an end of the extension cord is described. The end is illuminated if it is connected to an active power source with or without a functioning ground conductor, depending upon the electrical configuration within the body. The body is formed from a translucent material having the illumination apparatus embedded within such that the illuminated body is visible from all directions.

23 Claims, 1 Drawing Sheet

ELECTRICAL POWER EXTENSION CORD

BACKGROUND OF THE INVENTION (a) Field of the Invention

This invention concerns extension cords for use with electrical devices. It is known to use an extension cord when an electrically powered device is to be used at a distance from a power source. This distance may be very great, and/or the path between the source and the device quite tortuous, such that it may not be readily apparent to an operator at the device whether the extension cord remains connected to an active power source.

It is further known that a three-wire system, including a ground connection, is imperative for the safe operation of electrical devices. In the past, it has been common practice to periodically test the ground conductor to insure the ground is properly connected. Routine inspections are time consuming and are no guarantee against the ground continuity being broken between inspections.

(b) Description of Related Art

U.S. Pat. No. 4,671,597 to Grill discloses an electrical receptacle having a power indicating light which is removably disposed behind a semi-cylindrical transparent window. The Grill device has the disadvantages of requiring additional manufacturing steps to install the indicator light, the indicator light is not readily viewable from all angles, and because the indicator light is not sealed within the receptacle, it is susceptible to damage from abuse and the environment. U.S. Pat. No. 4,606,597 to Bielefeld discloses an electrical connector having an indicator lamp for indicating the availability of electrical current through the connector, however, the Bielefeld device has the same disadvantages as that of Grill. U.S. Pat. No. 4,520,239 to Schwartz discloses an electrical cord reel and storage system which includes an indicator light which is illuminated when connected to a source of electrical power. U.S. Pat. No. 3,924,914 to Banner discloses an electrical safety grounding device including a fuse, a power indicator, and/or a ground continuity indicator. The Banner device is not an extension cord having an elongated flexible cable and the indicator can only be viewed from specific angles. U.S. Pat. Nos. 3,753,261 (Thaxton), 3,588,861 (Meyer) and 3,559,200 (Walters) disclose similar devices to that of Banner. U.S. Pat. No. 3,171,113 to McNamara discloses a modified plug connector having a ground continuity indicator and which is further capable of adapting to either two or three wire systems. U.S. Pat. No. 2,731,629 to Siderman discloses a wiring assembly similar to, and having the same disadvantages as the device of Grill. U.S. Pat. No. 2,503,677 to McHenry et al. discloses a translucent light bulb socket having a defective bulb indicator. The McHenry et al. indicator is connected across each of a string of series connected light bulbs and is used to determine the location of the defective bulb. U.S. Pat. No. 2,474,407 to Todd et al. discloses a modified plug connector having a polarity indicator for a two wire system. U.S. Pat. No. 2,449,150 to Schnoll discloses a power indicating device similar to that of Thaxton. U.S. Pat. Nos. 2,112,137 (Brach), 1,935,771 (Feurstein et al.), 1,720,463 (Both) and 1,665,987 (Smith) disclose modified connecting apparatus having a power indicators. Canadian Patent 717,200 to Roll et al. discloses an electrical plug connector having an indicating light, however, the device is for a two wire, non-grounded system, and the indicator light is not readily viewable from all angles.

SUMMARY OF THE INVENTION

The present invention is an electrical power extension cord including translucent end connectors having illuminated indicators embedded within the connectors. The indicators positively identify when the extension cord is connected to an active power source and/or an activated power source having a functional ground conductor.

It is an object of the invention to provide an illuminated end connection which is readily visible from all angles. The omnidirectional characteristics of the extension cord are achieved by using a translucent end connection.

Another object of the invention is to provide a rugged, tamper-proof, water-proof indicator means. Because the indicator means is embedded within the end connection, the indicator cannot be impinged upon by the environment or be disconnected. Further, the indicator is ruggedly encased within a solid molded plug.

Another object of the invention is to provide an extension cord which is easily manufactured. Incorporating the indicator prior to forming the end connector eliminates the need for further assembly after the end connectors have been securely formed onto the electric cable.

Another object of the invention is to provide a simple way to quickly locate the end of an extension cord by providing an illuminated end connection which may be easily spotted even in dirty or dark environments.

DESCRIPTION OF THE PREFERRED EMBODIMENT

Figure 1:
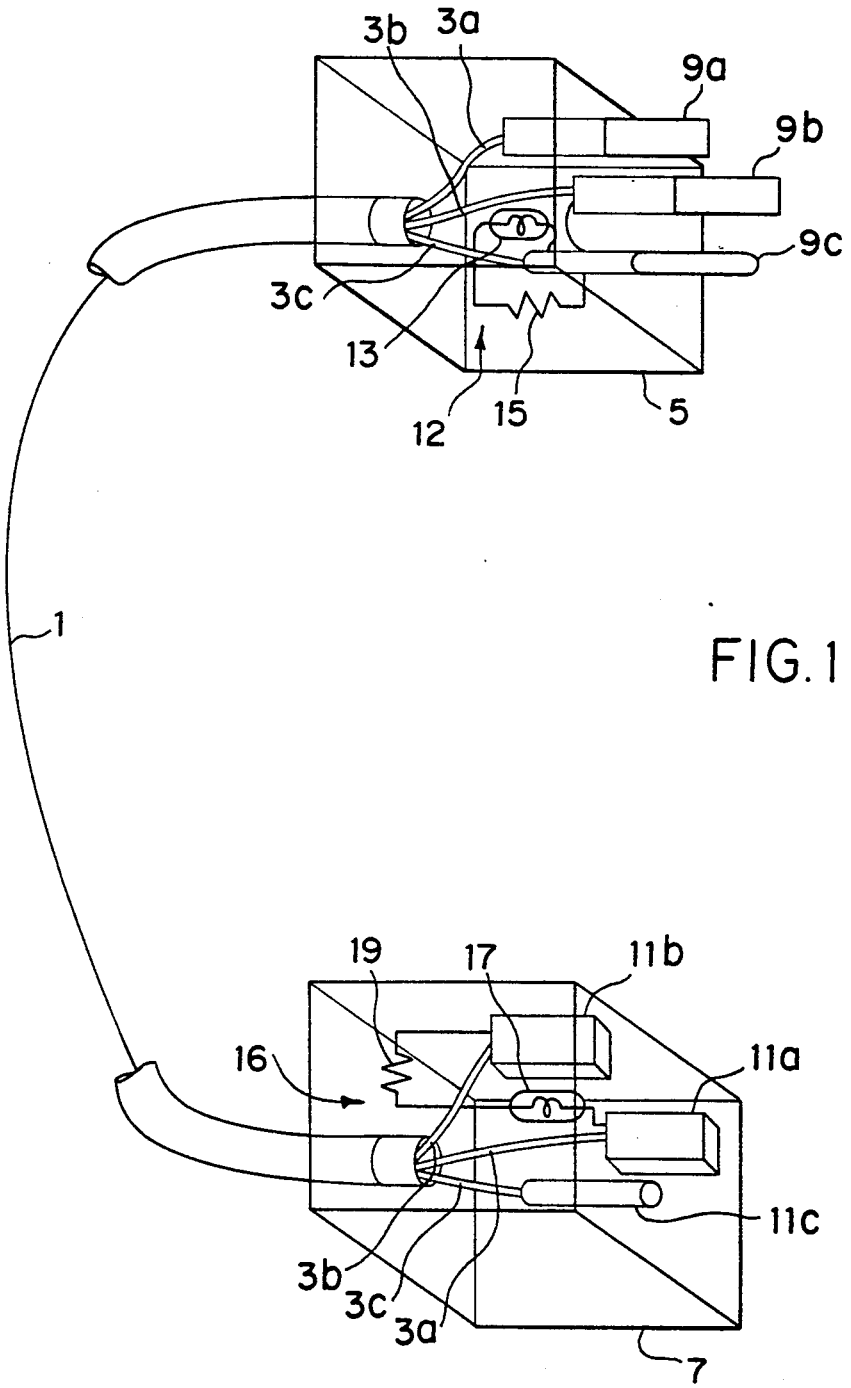
FIG. 1 is a partially schematic isometric view of the present invention.

Referring to FIG. 1, an elongated flexible cable 1 contains a plurality of wire conductors 3*a*, 3*b*, 3*c*. Conductors 3*a*, 3*b*, commonly referred to as the "hot" and neutral conductors, convey electrical power from a source. Conductor 3*c*, commonly referred to as the ground conductor, provides a path for electricity to flow in the event of a short circuit, thereby preventing injury or damage.

At respective distal ends of the flexible cable 1 are a first body 5 and a second body 7. The first body 5 is commonly referred to as a male connecting end because a plurality of conductive prongs 9*a*, 9*b*, 9*c* partially project out from the first body 5. The second body 7 is commonly referred to as a female connecting end because a plurality of receptacles 11*a*, 11*b*, 11*c* extend into the second body 7. The first and second bodies 5, 7 are formed from a translucent material and hold the respective prongs 9*a*, 9*b*, 9*c* and receptacles 11*a*, 11*b*, 11*c* in a standard pattern such that the first body 5 may be mated to the second body 7 with a plurality of non-intersecting conductive loops resulting.

Embedded within the first body 5 is a first type of indicator 12 which, when illuminated, indicates positively that the extension cord is connected to an active power source including a functional ground conductor. The first indicator 12 includes a first electric bulb 13 series connected to a first resistor 15. The first indicator 12 is connected at one end to either the "hot" or neutral conductor 9a, 9b, and at the other end to the ground conductor 9c.

Embedded within the second body 7 is a second type of indicator 16 which, when illuminated, indicates positively that the extension cord is connected to an active power source. The second indicator 16 includes a second electric bulb 17 series connected to a second resistor 19. The second indicator 16 is connected at one end to one of the "hot" or neutral conductors 9a, 9b, and at the other end to the other of the "hot" or neutral conductors 9a, 9b.

It is anticipated that either of the types of indicators 12, 16 may be embedded within the first and second bodies 5, 7 and that a single extension cord may have only one indicator, two of the same type of indicator, or one of each type of indicator, as shown in FIG. 1.

The electric bulbs are preferably neon bulbs and the resistors are sized to create a significant voltage drop whereby the electric bulb receives a minimal voltage for maximizing bulb life expectancy. It is also anticipated that other types of electric bulbs may be used with or without a series resistor.

The bodies are formed by positioning the appropriate prongs, receptacles, and indicator (already electrically connected) within a mold cavity, introducing the translucent material into the mold, and allowing the translucent material to encase and secure the components.

Because the indicator is ruggedly embedded within the translucent material of the body, it will be resistant to tampering, water as well as other environmental effects, and damage due to abuse.

Since the entire body is formed from translucent material, an illuminated indicator within the body will be readily visible from all angles and directions. It is anticipated that providing a textured surface on the exterior of the body and/or adding a pigment to the translucent material may enhance the visibility of the indicator. It is further anticipated that a transparent material could alternatively be used to form the body. Finally, it is anticipated that any powered device cord may incorporate a translucent body including an indicator means.

The drawing and description of the preferred embodiment should not be construed to limit the scope of the invention which is encompassed only by the claims appended hereto.

What is claimed is:

1. An elongated electrical power extension cord comprising:

a translucent first body having a plurality of conductive prongs projecting from said first body;

a translucent second body having a plurality of conductive receptacles extending into said second body;

said prongs and said receptacles are arranged in a corresponding pattern such that said first body is adapted to be mated with said second body;

an elongated flexible cable means for extending between and electrically connecting corresponding ones of said prongs and said receptacles, said elongated cable means having a plurality of conductors; and illumination means for indicating the presence of a desirable electrical condition, said illumination means are embedded within both said first and second bodies.

2. The electrical power extension cord of claim 1, wherein at least one of said illumination means indicates positively when said electrical power extension cord is connected to an active power source.

3. The electrical power extension cord of claim 1, wherein at least one of said illumination means indicates positively when said electrical power extension cord is connected to an active power source having a functional ground conductor.

4. The electrical power extension cord of claim 2, wherein both of said illumination means indicate positively when said electrical power extension cord is connected to an active power source.

5. The electrical power extension cord of claim 3, wherein both of said illumination means indicate positively when said electrical power extension cord is connected to an active power source having a functional ground conductor.

6. The electrical power extension cord of claim 1, wherein one of said illumination means indicates positively when said electrical power extension cord is connected to an active power source, and another of said illumination means indicates positively when said electrical power extension cord is connected to an active power source having a functional ground conductor.

7. The electrical power extension cord of claim 1, wherein each of said illumination means is contiguously encapsulated within either said first body or said second body.

8. The electrical power extension cord of claim 1, wherein said illumination means comprises an electric light bulb.

9. The electrical power extension cord of claim 8, wherein said illumination means comprises a resistor in series with said electric light bulb.

10. The electrical power extension cord of claim 8, wherein said electric light bulb is a neon bulb.

11. The electrical power extension cord of claim 1, wherein at least one of said first body and said second body has a textured exterior surface.

12. The electrical power extension cord of claim 1, wherein at least one of said first translucent body and said second translucent body is pigmentized.

13. The electrical power extension cord of claim 1, wherein at least one of said first translucent body and said second translucent body is transparent.

14. An electrical power extension comprising:

a translucent first body having a plurality of conductive prongs projecting from said first body;

a translucent second body having a plurality of conductive receptacles extending into said second body;

said prongs and said receptacles are arranged in a corresponding pattern such that said first body is adapted to be mated with said second body, and wherein each corresponding prong and receptacle are adapted to be electrically connected by a plurality of conductors extending between said first body and said second body; and illumination means for indicating the presence of a desirable electrical condition, said illumination means are embedded within both said first and second bodies.

15. The electrical power extension of claim 14, wherein at least one of said illumination means indicates positively when said electrical power extension is connected to an active power source.

16. The electrical power extension of claim 14, wherein at least one of said illumination means indicates positively when said electrical power extension is connected to an active power source having a functional ground conductor.

17. The electrical power extension of claim 14, wherein each of said illumination means is contiguously encapsulated within either said first body or said second body.

18. The electrical power extension of claim 14, wherein said illumination means comprises an electric light bulb.

19. The electrical power extension of claim 18, wherein said illumination means comprises a resistor in series with said electric light bulb.

20. The electrical power extension of claim 18, wherein said electric light bulb is a neon bulb.

21. The electrical power extension of claim 14, wherein at least one of said first body and said second body has a textured exterior surface.

22. The electrical power extension of claim 14, wherein at least one of said first translucent body and said second translucent body is pigmentized.

23. The electrical power extension of claim 14, wherein at least one of said first translucent body and said second translucent body is transparent.

* * * * *